US009879409B2

(12) United States Patent
Conrad

(10) Patent No.: US 9,879,409 B2
(45) Date of Patent: Jan. 30, 2018

(54) MULTI-STAGE TOILET FLUSH VALVE

(71) Applicant: Mansfield Plumbing Products, LLC, Perrysville, OH (US)

(72) Inventor: Paul Conrad, Ashland, OH (US)

(73) Assignee: Mansfield Plumbing Products, LLC, Perrysville, OH (US)

( * ) Notice: Subject to any disclaimer, the term of this patent is extended or adjusted under 35 U.S.C. 154(b) by 0 days.

(21) Appl. No.: 15/302,754

(22) PCT Filed: May 8, 2015

(86) PCT No.: PCT/US2015/029919

§ 371 (c)(1),
(2) Date: Oct. 7, 2016

(87) PCT Pub. No.: WO2015/172042

PCT Pub. Date: Nov. 12, 2015

(65) Prior Publication Data

US 2017/0030062 A1 Feb. 2, 2017

Related U.S. Application Data

(60) Provisional application No. 61/990,919, filed on May 9, 2014.

(51) Int. Cl.
*E03D 1/34* (2006.01)
*E03D 1/30* (2006.01)
(Continued)

(52) U.S. Cl.
CPC ..... *E03D 1/306* (2013.01); *E03D 1/24* (2013.01); *E03D 1/35* (2013.01); *E03D 5/092* (2013.01);
(Continued)

(58) Field of Classification Search
CPC ..... E03D 1/30
(Continued)

(56) References Cited

U.S. PATENT DOCUMENTS 1,472,191 A 10/1923 Nichols et al.
1,850,354 A 3/1932 Owens
(Continued)

FOREIGN PATENT DOCUMENTS

BE 839283 A2 7/1976
DE 1905978 A1 8/1970
(Continued)

OTHER PUBLICATIONS

International Search Report PCT/US15/29919; 3 Pages: Form PCT/ISA/210, dated Jan. 2015.

*Primary Examiner* — Lori Baker
(74) *Attorney, Agent, or Firm* — Renner Kenner Greive Bobak Taylor & Weber

(57) ABSTRACT

A multi-stage toilet flush valve includes an inner valve and an outer valve that circumstribes the inner valve. The inner and outer valve control the flow of flushwater through associated inner and outer outlets. Thus, when the flush valve is actuated, the inner and outer valves are actuated at separate times, while the inner valve delivers flushwater to a rim of the toilet, while the outer valve delivers flushwater to a jet feed outlet in the toilet. As such the multi-stage toilet valve provides two independent inner and outer flushwater delivery outlets that are controlled by associated inner and outer valves that are capable of being actuated at separate times to control the ratio of flushwater delivered to a toilet rim and to a toilet jet feed outlet to enhance the effectiveness in which the toilet bowl is cleaned.

18 Claims, 12 Drawing Sheets

(51) Int. Cl.

| | |
|---|---|
| ***E03D 11/02*** | (2006.01) |
| ***E03D 5/092*** | (2006.01) |
| ***E03D 1/24*** | (2006.01) |
| ***E03D 1/35*** | (2006.01) |

(52) U.S. Cl.
CPC ..... *E03D 11/02* (2013.01); *E03D 2201/30* (2013.01)

(58) Field of Classification Search
USPC ..... 4/387
See application file for complete search history.

(56) References Cited

U.S. PATENT DOCUMENTS

| | | | |
|---|---|---|---|
| 5,349,981 | A | 9/1994 | Schmucki et al. |
| 7,325,258 | B2 | 2/2008 | Asada et al. |
| 2012/0198610 | A1 | 8/2012 | McHale et al. |

FOREIGN PATENT DOCUMENTS

| | | | |
|---|---|---|---|
| DE | 2610375 | A1 | 9/1977 |
| EP | 0606678 | A1 | 7/1994 |
| EP | 1854926 | A1 | 11/2007 |
| WO | 2014078461 | A3 | 3/2014 |

MULTI-STAGE TOILET FLUSH VALVE

CROSS-REFERENCE TO RELATED APPLICATION

This application claims the benefit of U.S. Provisional Application No. 61/990,919 filed May 9, 2014, the contents of which are incorporated herein by reference.

TECHNICAL FIELD

The present invention is directed to toilet flush valves. More particularly, the present invention is directed to multi-stage toilet flush valves. In particular, the present invention is directed to a multi-stage toilet flush valve that provides multiple inter-connected flushwater valves that deliver flushwater to two independent flushwater outlets, in which one flushwater outlet delivers flushwater to a toilet rim and the other flushwater outlet delivers flushwater to a toilet jet feed outlet.

BACKGROUND

Multi-stage toilet valves, such as that described in U.S. Pat. No. 7,325,258, utilize two flush valves, which are physically separated from each other. These physically separate flush valves are operatively coupled together by a common linkage. As such, when the linkage is actuated by movement of a lever connected thereto, the flush valves open, allowing flushwater to flow into the rim and the jet feed outlet of the toilet bowl in order to carry waste out of the bowl. Thus, the two flush valves of the '258 patent operate in a parallel configuration, such that the flush water from each of the valves is delivered to the toilet bowl at substantially the same time. In other words, because the two flush valves of the '258 patent are coupled to the common linkage, there is no ability to adjust the time at which each of the flush valves are actuated relative to one another.

As such, it would be desirable to provide a flush valve that has the ability to adjust the time at which each of the two flush valves are activated, such that a first flush valve is opened at a first instant, and a second flush valve is be opened at a subsequent time following the actuation of the first flush valve.

Therefore, there is a need for a multi-stage toilet flush valve of the present invention that includes two independent flushwater outlets, whereby flushwater is delivered to the outlets independently at separate times. Additionally, there is a need for a multi-stage toilet flush valve of the present invention that allows increased control over the ratio of flushwater that is delivered to a rim and to a jet feed outlet of a toilet, so as to optimize the cleaning of the toilet bowl during the operation of the toilet.

SUMMARY OF THE INVENTION

It is one aspect of the present invention to provide a single multi-stage flush valve or single grouping of flush valves for use within a siphonic, gravity-flush toilet, which allows a staggered start and/or shut-off sequence of multiple flush valve seats relative to one another is achieved, while only requiring one user input to start the flushing sequence. Subsequent valve seatings or closures after the initial valve seating or closure are triggered indirectly by either hydraulic or mechanical forces from a previous flush valve operation. The flush valve or flush valves have two or more water discharge valve seats fluidly connected to two or more separate outlets that are provided by the valve. A portion of the valve seats and valve outlets are in fluid communication with the jet or jets within the toilet bowl, while remaining portion of the valve seats and valve outlets are in fluid communication with rim of bowl or other outlets within the pan of the bowl above the water spot.

In another aspect of the present invention, the valve or valves are configured, such that the initial valve seat is opened by the user and acts as a pilot valve for the remaining valve seats to open hydraulically or with the release of potential energy.

Yet another aspect of the present invention is that the valve or valves are configured, such that the initial valve seat is opened by the user and the initial valve mechanical triggers subsequent valve openings.

It is another aspect of the present invention to provide a multi-stage flush valve for use within a siphonic, gravity-flush toilet, whereby a flush valve has two or more water discharge valve seats fluidly connected to two or more separate outlets of the valve. A portion of the valve seats and outlets are in fluid communication with the jet or jets within the toilet bowl, and the remaining portion of valve seats and outlets are in fluid communication with the rim of the bowl or other outlets within the pan of the bowl above the water spot.

Yet another aspect of the present invention is to provide a flush valve to be mounted in a tank of a toilet, the flush valve comprising a body including a first vessel and a second vessel, wherein the first and second vessels are separated by an inner wall having at least one control port disposed therein to allow the first and second vessels to be in fluid communication with each other; a first valve provided in the first vessel to control the flow of fluid therein through a first valve outlet; and a second valve provided in the second vessel to control the flow of fluid therein through a second valve outlet; wherein the release of a predetermined amount of fluid from the first vessel through the first valve outlet upon the activation of the first valve, activates the second valve to release fluid from the second vessel through the second valve outlet.

In another aspect of the present invention a method of operating a toilet flush valve in a tank of a toilet comprises: providing a first flush valve to control the flow of fluid out of a first outlet, the first outlet in fluid communication with a first vessel, a second vessel in operative communication with the first vessel, said second valve configured to control the flow of fluid out of a second outlet, the second outlet in fluid communication with a second vessel; actuating the first valve; releasing water out of the first vessel; actuating the second valve after a predetermined amount of water is released from the first vessel; and releasing water out of the second vessel.

BRIEF DESCRIPTION OF THE DRAWINGS

These and other features and advantages of the present invention will become better understood with regard to the following description, appended claims, and accompanying drawings, wherein:

DETAILED DESCRIPTION

Figure 1:
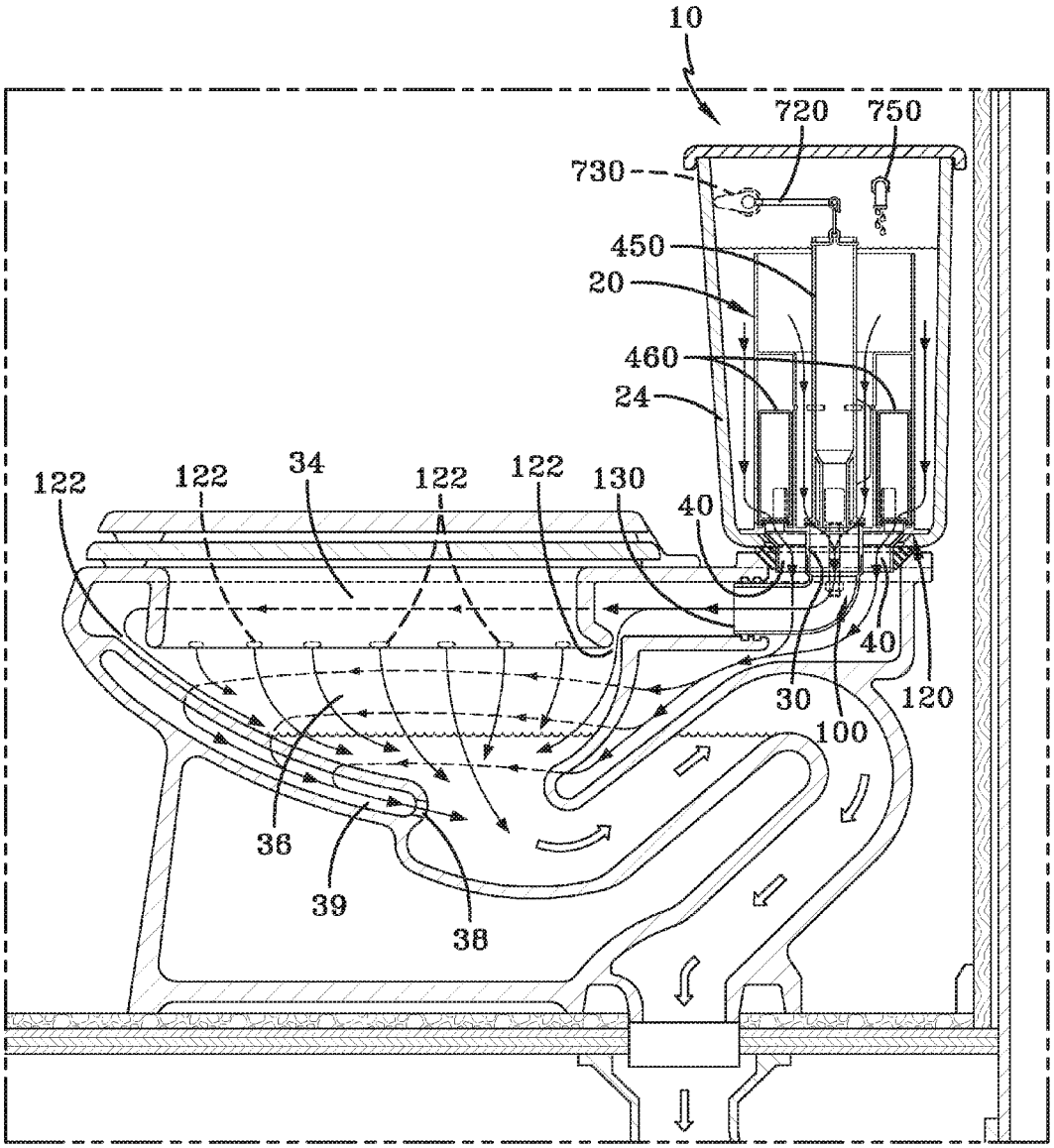
FIG. 1 is a cross-sectional view of a toilet bowl and tank that includes a multi-stage flush valve in accordance with the concepts of the present invention.

A multi-stage flush valve for a toilet 10 is generally referred to by numeral 20, as shown in FIG. 1 of the drawings. The flush valve 20 is mounted in a tank 24, which carries flushwater therein that is provided by the toilet 10, such as a siphonic. As such, the flush valve 20 operates to control the flow of flushwater, through an inner outlet 30, and an outer outlet 40 that circumscribes the inner outlet 30. Thus, the inner outlet 30 serves as a first stage water outlet, whereby flushwater from the tank 24 flows through the inner outlet 30 directly to an upper rim 34 of the toilet 10 for delivery to a bowl portion 36 of the toilet 10. Circumscribing the inner outlet 30 is the larger annular outer outlet 40, which serves as a second stage water outlet, that delivers flushwater directly to a jet feed outlet or jet 38 that is disposed at the bottom of the toilet bowl 36 via a jet conduit 39. In other words, the inner outlet 30 of the flush valve 20 delivers flushwater directly to the rim 34 of the toilet 10, while the outer outlet 40 delivers flushwater directly to the jet 38 of the toilet 10. As such, the multi-stage flush valve 20 includes two separate and independent outlets, which operates to deliver flushwater at separate times, such that the inner outlet 30 provides flushwater at a first stage, and the outer outlet 40 provides flushwater at a second subsequent, stage.

In particular, the multi-stage flush valve 20 comprises an inner valve 100, and an outer valve 120 that circumscribes the inner valve 100, whereby the inner valve 100 and the outer valve 120 are in fluid communication with inner outlet 30 and outer outlet 40, respectively. In other words, the inner and outer valves 100,120 are positioned with one within the other, and the inner and outer outlets 30,40 are arranged with one within the other. In some embodiments, the inner and outer outlets 30,40 may be arranged to be concentric with each other, and the inner and outer valves 100,120 may be arranged to be concentric with each other. The inner and outer valves 100,120 and associated inner and outer outlets 30,40 are configured, so as to supply flushwater to the toilet 10 at separate stages/times of a flush operation or sequence of the toilet 10 to be discussed. For example, as shown in FIG. 1, the inner flush valve 100 feeds or supplies flushwater to an elbow 130 that is fluidly attached to the inner outlet 30, which delivers the flushwater to the rim or rim conduit 34 of the toilet bowl 36. Once the flushwater enters the rim 34, the flushwater is permitted to flow through various openings or ports 122 in fluid communication with the rim 34 and into the bowl 36. Additionally, while the outer flush valve 120 feeds or supplies flushwater to the outer outlet 40 that delivers the flushwater to the jet feed outlet or jet outlet 38 that is positioned near the bottom of the bowl 36 of the toilet 10.

Figure 2:
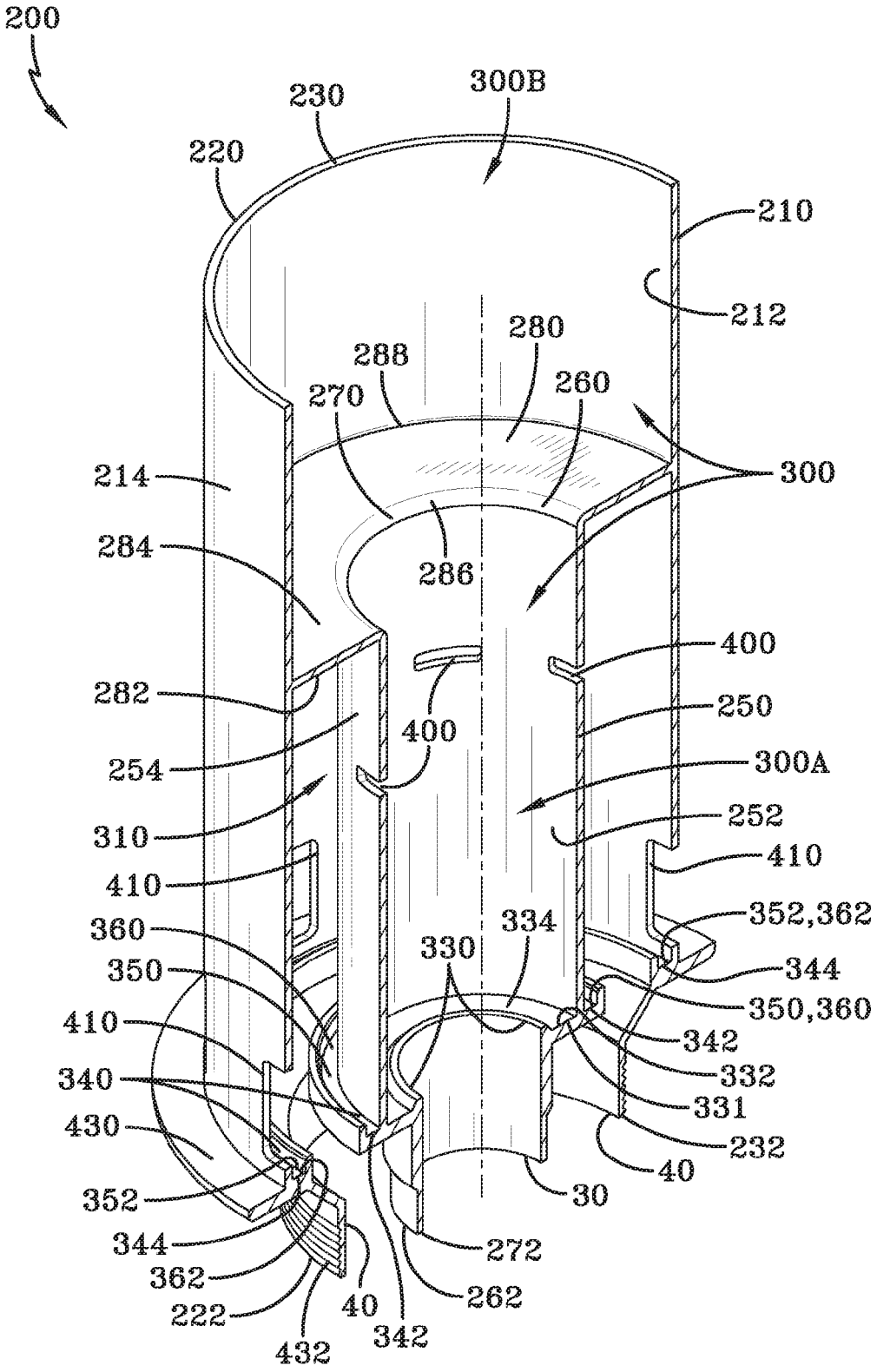
FIG. 2 is a cross-sectional view of a valve body provided by the multi-stage flush valve in accordance with the concepts of the present invention.
Figure 3:
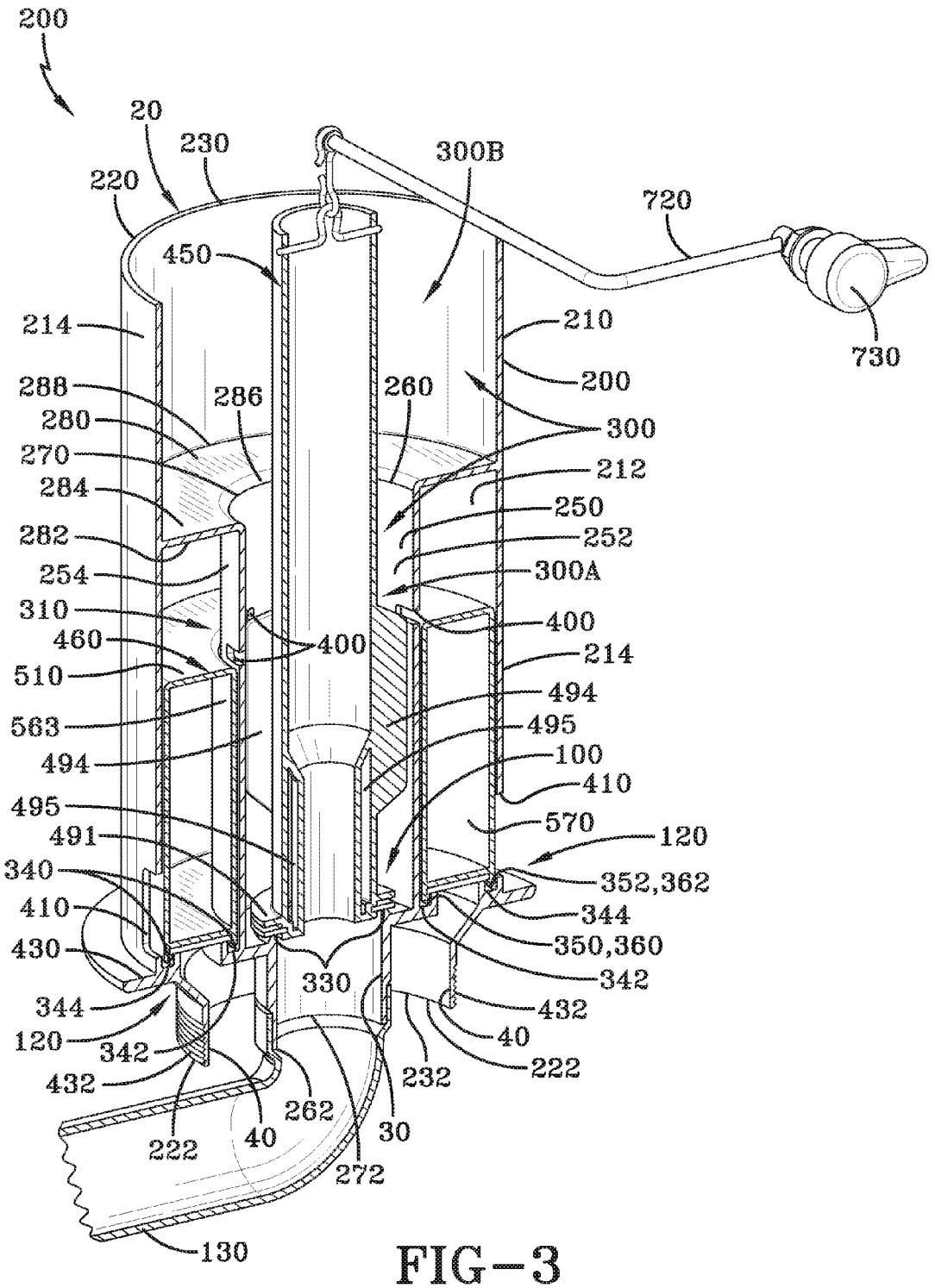
FIG. 3 is a cross-sectional view of the multi-stage flush valve that includes an inner valve and an outer valve in accordance with the concepts of the present invention.

The inner and outer valves 100 and 120 are carried by a valve body 200, as shown in FIGS. 2 and 3. The valve body 200 includes a substantially cylindrical outer wall 210 having opposed inner and outer surfaces 212 and 214, which are bounded by upper and lower apertures 220 and 222 at respective ends 230 and 232. It should be appreciated that while the outer wall 210 is discussed herein as being substantially cylindrical, it may be any suitable shape. Disposed within the outer cylindrical wall 210 is a substantially cylindrical inner wall 250, which is co-axial with, and spaced apart from, the inner surface 212 of the cylindrical outer wall 210. The cylindrical inner wall 250 includes opposed inner and outer surfaces 252 and 254, which are bounded by upper and lower apertures 260 and 262 at respective ends 270 and 272. Thus, the inner surface 212 of the outer wall 210 is spaced from the outer surface 252 of the inner wall 250. It should be appreciated that the inner wall 250, while discussed as being substantially cylindrical, may be any suitable shape. It should also be appreciated that the valve body 200, and the components forms the valves 100,120 carried therein to be discussed may be formed from any suitable material, such as plastic for example. In some embodiments, the inner wall 250 and the outer wall 210 may be concentric with each other.

In order to join or connect the inner and outer walls 250,210 together, the valve body 200 provides an annular dividing section 280. That is, the outer surface 254 of the cylindrical inner wall 250 is attached to, and spaced apart from, the inner surface 212 of the outer wall 210 by the annular dividing section 280. The annular dividing section 280 has opposed inner and outer surfaces 282 and 284 that are bounded by inner and outer curved edges 286 and 288. As such, the outer curved edge 288 of the dividing section 280 is attached to the inner surface 212 of the outer wall 210 and the inner curved edge 286 of the dividing section 280 is attached to the outer surface 254 of the inner wall 250. Thus, the annular dividing section 280 serves to attach or join the outer and inner walls 210, 250 together, while also serving to space the outer and inner walls 210,250 apart. Furthermore, the annular dividing section 280 is positioned proximate, and in some embodiments adjacent to, to the upper aperture 260 of the cylindrical inner wall 250, such that the annular section 280 circumscribes the outer surface 254 of the inner wall 250. As such, the annular dividing section 280 and the upper aperture 260 of the inner wall 250 are both positioned to be proximate to the upper aperture 220 of the outer wall 210 of the valve body 200. Thus, the annular dividing section 280 and the inner wall 250 serve to divide the inner volume defined by the larger outer wall 210 of the valve body 200 into an inner vessel or cavity 300 and an outer vessel or cavity 310. In addition, the lower apertures 222 and 262 of the respective outer and inner walls 210,250 are each configured to terminate in the same plane with each other, so as to be substantially flush with each other, and are spaced apart from each other to form the outer outlet 40, while the lower aperture 262 of the inner wall 250 defines the inner outlet 30.

Positioned proximate to the lower aperture 262 of the inner wall 250 is an annular inner valve seat 330. In one embodiment, the inner valve seat 330 may be formed as a substantially annular seat section 331 having a seat surface 332 that extends at a substantially right angle from the inner surface 252 of the inner wall 250. In some embodiments, the seat surface 332 may include a recessed channel 334. In addition, proximate to the lower apertures 262, 222 of respective inner and outer walls 250, 210 is an annular outer valve seat 340. The outer valve seat 340 comprises a substantially annular inner seat section 342 and a substantially annular outer seat section 344. As such, the inner seat section 342 extends at a substantially right angle from the outer surface 254 of the inner wall 250, and the outer seat section 344 extends at a substantially right angle from the inner surface 212 of the outer wall 212. The inner and outer seat sections 342 and 344 include respective seat surfaces 350 and 352, each of which may include respective channels 360 and 362. While the inner and outer valve seats 330 and 340 are discussed herein as being spaced proximate to the ends 232 and 272 of the inner and outer walls 250 and 210 of the valve body 200, they may be located at any suitable position relative to the ends 232,272.

Thus, as previously discussed, the outer wall 210, the inner wall 250 and the annular dividing section 280 separate the valve body 200 into the inner and outer cavities/vessels 300 and 310, as shown in FIGS. 2 and 3. Specifically, the inner cavity/vessel 300 is defined by the volume of the valve body 200 that is contained by the inner surface 252 of the inner wall 250, the outer surface 284 of the annular dividing section 280 and the inner surface 212 of the outer wall 210. It should also be appreciated that the inner cavity/vessel 300 includes a lower inner cavity 300A that is defined substantially by the volume of the valve body 200 that is contained within the inner wall 250, and an upper inner cavity 300B that is defined substantially by the volume contained by the portion of the outer wall 210 that extends above the annular dividing section 280 to the upper end 220 of the outer wall 210. As such, the inner cavity 300, which comprises the lower and upper inner cavities 300A and 300B, are in fluid communication with the inner outlet 30 of the multi-stage flush valve 20. In addition, the outer cavity/vessel 310 is defined by the volume of the body 200 that is contained by the inner surface 212 of the outer wall 210, the inner surface 282 of the annular section 280 and the outer surface 254 of the inner wall 250. As such, the outer cavity 310 is in fluid communication with the toilet tank 24 and the outer outlet 40 in a manner to be discussed.

To control the flow of flushwater into and out of the inner and outer cavities/vessels 300,310 various ports are provided in the inner and outer walls 210, 250. Specifically, disposed through the inner wall 250 at a point proximate to the upper end 270 of the inner wall 250 are one or more inner control ports 400, which control the flow of flushwater moving between the outer cavity/vessel 310 and the inner cavity/vessel 300. Specifically, the position of the inner control ports 400 defines the height of a water column that is permitted to be formed within the outer cavity/vessel 310, which will be discussed in detail below. It should also be appreciated that the control ports 400 may have any suitable dimension and shape. In order to control the flow of flushwater entering the outer cavity/vessel 310 from the tank 24 of the toilet 20 are one or more outer control ports 410 that are disposed through the outer wall 210 of the flush valve body 200. The outer control ports 410 are positioned proximate to the valve seat 340. Thus, the outer control ports 410 are positioned at a height that is below the inner control ports 400.

To facilitate mounting the flush valve 20 to the toilet 10, an annular mounting flange 430 is provided, which circumscribes the outer surface 214 of the outer wall 210 at a point proximate to the ends 232, 272 of the outer and inner wall 210,250. In addition the outer surface on the outer wall 210 may include threads 432 that are configured to threadably retain a fastening nut 712.

Figure 4:
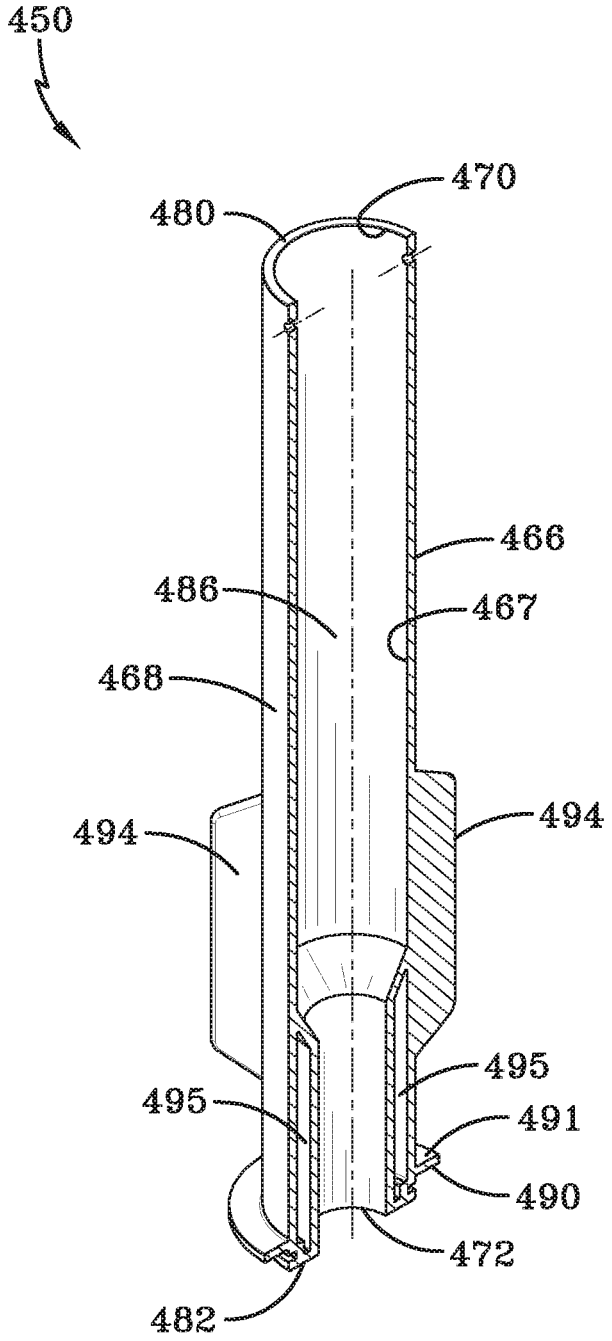
FIG. 4 is a cross-sectional view of an inner float of the multi-stage flush valve in accordance with the concepts of the present invention.

In order to control the flow of flushwater through the inner and outer outlets 30,40 of the flush valve 20, an inner float 450 is positioned within the inner cavity 300, and an outer float 460 is positioned within the outer cavity 310, as shown in FIG. 3. Specifically, the inner float 450, shown in FIG. 4, includes a substantially cylindrical, elongated, and hollow body 466 having an inner and outer surface 467,468. However, in other embodiments, the body 466 of the inner float 450 may be configured as any suitable shape. The inner float 450 has opposed upper and lower float apertures 470 and 472 disposed at respective upper and lower ends 480 and 482. Thus, due to the hollow configuration of the inner float 450, flushwater is permitted to enter a float cavity 486 that is contained within the inner float 450, which is in fluid communication with the upper and lower float apertures 470,472. Positioned proximate to the lower end 482 of the inner float 450 is a valve stop 490 that is configured to be selectively seated in a watertight manner on the inner valve seat 330 of the valve body 200. In one aspect, the valve stop 400 comprises an annular flange 491 that circumscribes the outer surface 468 of the inner float 450. As such, the inner float 450 is configured to be moved, or slid, substantially vertically upward and downward within the lower inner cavity 300A of the valve body 200 relative to the inner valve seat 330, so as to selectively open and close the inner outlet 30, thereby controlling the flow of flushwater therethrough. To facilitate the upward and downward movements, and to stabilize the movement of the inner float 450, the inner float 450 includes one or more guide arms or ribs 494 that extend radially from the outer surface 468, which glide along the inner surface 252 of the cylindrical inner wall 250 forming the lower inner cavity 300A. The inner float 450 also includes an air chamber 495, which is positioned proximate to the lower end 482, and contributes to the buoyancy of the inner float 450. In one embodiment, the air chamber 470 may comprise an annular chamber 470. It is also contemplated that the inner float 450 may be formed of any suitable material, such a plastic or metal.

Figure 5:
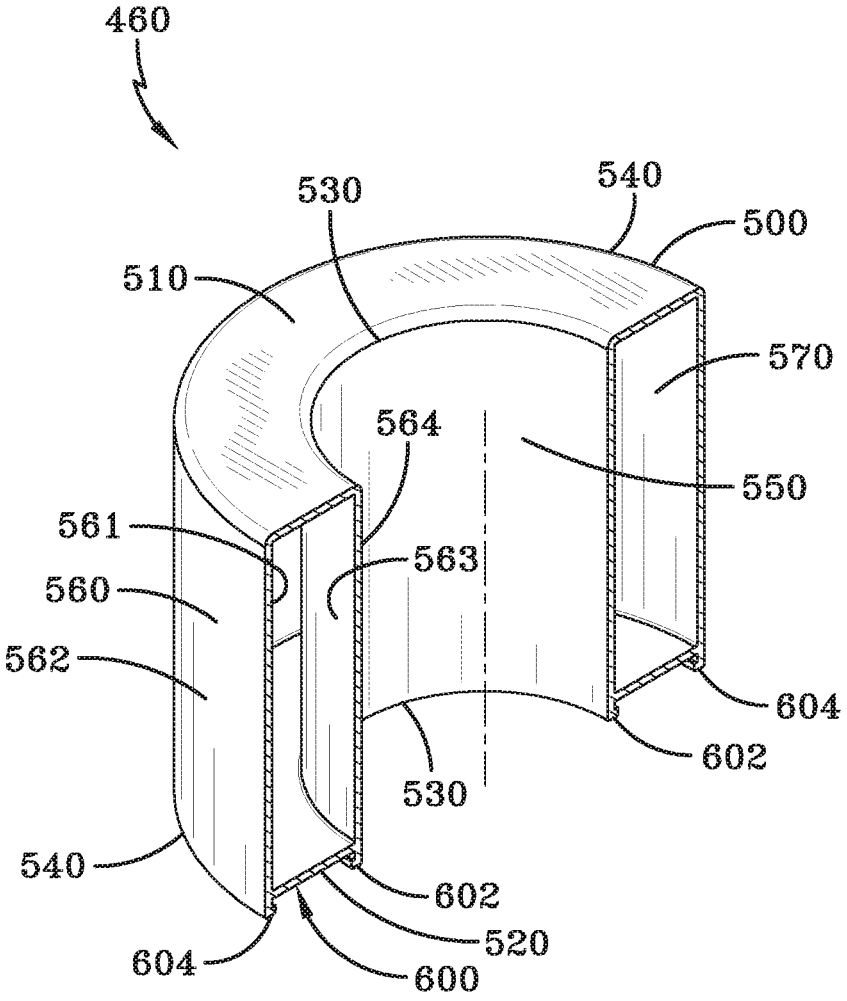
FIG. 5 is a cross-sectional view of an outer float of the multi-stage flush valve in accordance with the concepts of the present invention.

The outer float 460, shown in FIG. 5, has as an elongated annular body 500 that has an upper annular section 510, which is spaced apart from a lower annular section 520. Each of the upper and lower annular sections 510,520 is bounded by an inner curved edge 530 and an outer curved edge 540. As such, the inner edges 530 of the annular sections 510,520 are joined together by a curved inner float wall 550, and the outer edges 540 of the annular surfaces 510,520 are joined together by a curved outer float wall 560. In addition, the outer float wall 560 has inner and outer surfaces 561,562, while the inner float wall 550 has inner and outer surfaces 563,564. Together, the upper and lower annular sections 510 and 520 and inner and outer float walls 550,560 define an air chamber or hollow cavity 570 therein to facilitate the buoyancy of the outer float 460. It should be appreciated that the lower annular surface 520 is configured as a valve stop 600 and is suitably dimensioned, so that the inner and outer edges 530,540 of the lower annular section 520 are capable of being seated on the respective inner and outer seating surfaces 350,352 of the outer valve seat 340. In one embodiment, the valve stop 600 may include inner and outer arms 602,604, which extend from the lower section 520 at respective inner and outer edges 530,540, and are configured to be retained within respective channels 360, 362. That is, the outer float 460 is configured to move or slide substantially vertically upward and downward within the outer cavity 310 of the valve body 200 relative to the outer valve seat 340, so as to selectively open and close the outer outlet 40, thereby controlling the flow of flushwater therethrough. In addition, the gap that is formed between the outer surface 562 of the outer float wall 560 and the inner surface 212 of the outer wall 210 of the valve body 200; and the gap that is formed between the outer surface 564 of the inner float wall 550 and the outer surface 254 of the inner wall 250 wall of the valve body 200 is dimensioned so that such gaps are made suitably small, so that flushwater is prevented from seeping or flowing through such gaps. In addition, the height dimension of the outer float 460, which is the distance between the upper and lower annular sections 510,520 is chosen so that when the lower annular section 520 is resting upon the outer valve seat 340, the outer float 460 blocks or closes the outer control ports 410, while the inner control ports 400 are opened to allow the flow of flushwater between the inner and outer cavities 300, 310. In addition, the height dimension of the outer float 460 is also chosen so that when the upper annular section 510 is positioned adjacent to the inner surface 282 of the dividing section 280, the inner control ports 400 are blocked or closed by the outer float 460, while the outer control ports 410 are opened to allow the flow of flushwater from the tank 24 of the toilet 10 to enter the outer cavity 310, where it is then routed to the outer outlet 40.

In order to place the flush valve 20 into operation, the lower end 232 of the outer wall 210 is disposed through a mounting aperture 700 provided in a bottom surface of the tank 24 of the toilet 10. The outer surface 214 of the outer wall 210 at a point proximate to the lower end 232 of the outer wall 210 of the valve body 200 includes the threads 432, which are configured to receive the threaded fastening nut 712 thereon to securely fasten the flush valve 20 to the tank 24 of the toilet 10. In addition, the vertically moving inner float 450 is coupled via suitable linkage 720 to a traditional trip or flush lever 730 that is provided on the outside of the toilet 10, which is actuated by a user. Specifically, the trip lever 730 is pivotably mounted and carried by the tank 24 of the toilet 10, such that when the trip lever 730 is actuated to initiate a flush sequence of the toilet 10, it pulls the inner float 450 upward from its associated inner valve seat 330, via the linkage 720. Furthermore, when the trip lever 730 is released, the inner float 450 is permitted to move downward toward its associated inner valve seat 330 in a manner to be discussed. It should be appreciated that the trip lever 730 may include any suitable actuation device, such as a mechanical or electro-mechanical device that is able to lift the inner float member 450 up and away from the valve seat 330.

Figure 6:
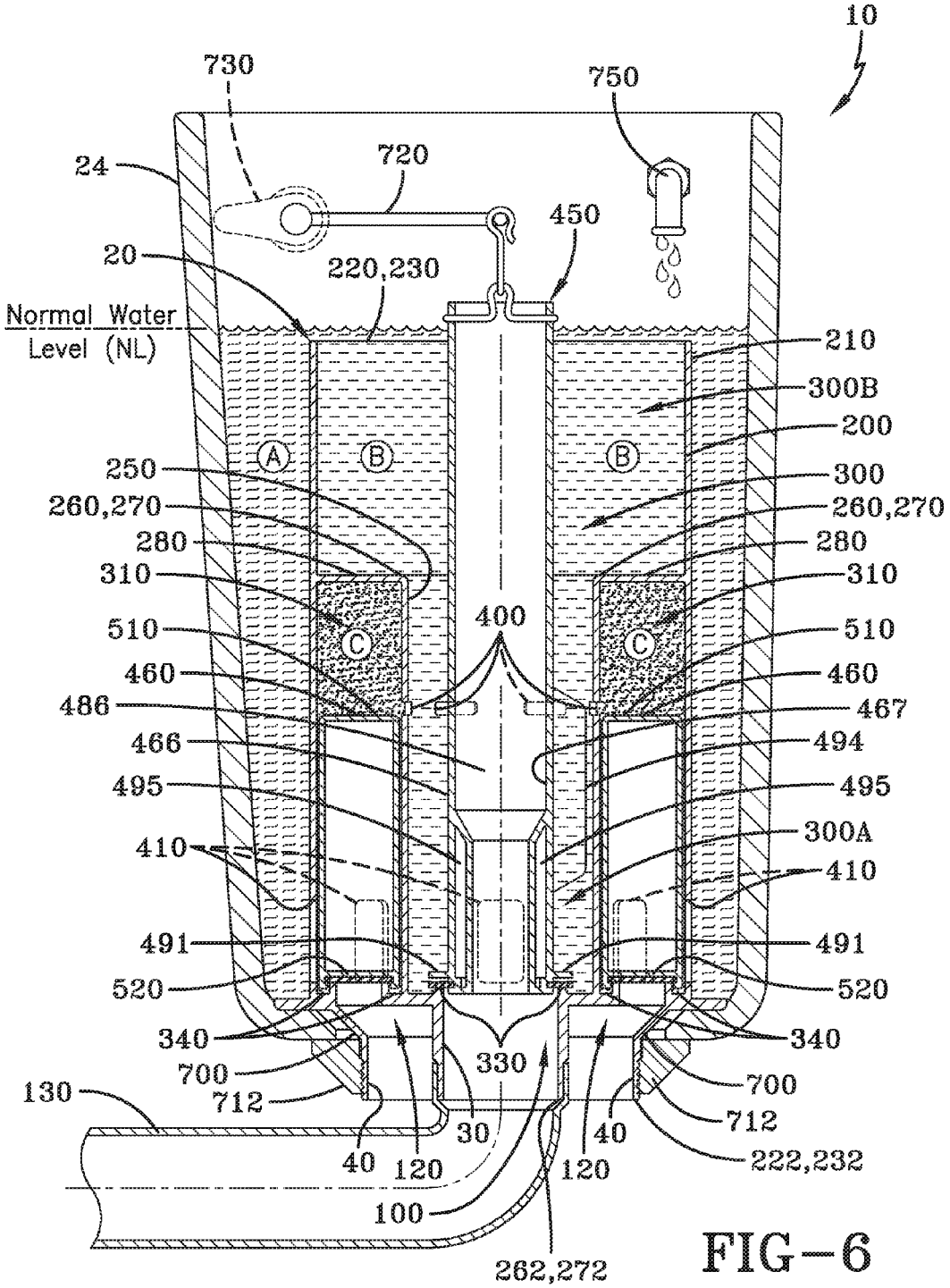
FIG. 6 is a cross-sectional view of the toilet tank and multi-stage flush valve showing the inner and outer valves in a closed state in accordance with the concepts of the present invention.

Once the flush valve 20 is installed in the toilet tank 24, the inner and outer floats 450,460 are initially positioned so that they rest upon the associated valve seats 330,340 to close the inner and outer outlets 30,40. Next, the tank 24 is filled with flushwater using any suitable filling mean, such as an automatic fill valve 750. As the tank 24 is being filled, the level of flushwater is permitted to rise above the upper end 230 of the outer wall 210, so as to fill the inner cavity/vessel 300, including lower and upper cavities 300A and 300B, and the outer cavity/vessel 310 with flushwater, as shown in FIG. 6. It should be appreciated that the inner control ports 400 allow flushwater to flow into the outer cavity/vessel 310 in a manner to be discussed. Due to the arrangement of the flush valve 20 within the tank 24 of the toilet 10, three discrete flushwater zones, or water columns, are formed within the toilet 10 and within the flush valve 20, which are designated by the identifiers 'A', 'B', and 'C', shown in FIGS. 6-12. In particular, identifier A, denotes the water column that resides within the tank 24 of the toilet 10, which is exclusive of the flushwater contained within the flush valve 20; identifier B denotes the water column that resides within the inner cavity/vessel 300 (including lower and upper cavities 300A and 300B); and identifier C denotes the water column that resides within the outer cavity/vessel 310, which is positioned above the upper annular section 510 of the outer float 460. Thus, the inner valve 100, which is comprised of the inner float 450 and the inner valve seat 330, is configured to carry out stage 1 of the flushing sequence by using water column B that is contained within the inner cavity/vessel 300 (300A-B) and water column C that is contained within the outer cavity/vessel 310, as shown in FIG. 6. The outer valve 120, which is formed of the outer float 460 and the inner valve sear 340, is configured to carry out stage 2 of the flushing sequence by using water column A that is contained within the tank 24 of the toilet 10. That is, stage 1 and stage 2 of the flush valve 20 refer to the independent delivery of flushwater from the inner outlet 30 and the outer outlet 40 by the respective inner and outer valves 100, 120, which are performed at separate times.

To illustrate the various stages or steps in the operation of the multi-stage flush valve 20 during the completion of the first and second flush stages, reference is made to FIGS. 6-12. Initially, at step or phase 0 of the operation of the valve 20, shown in FIG. 6, the inner float 450 is positioned at the bottom of its vertical travel, where it rests on the inner valve seat 330, so as to close the inner outlet 30, and the outer float 460 is positioned at the bottom of its vertical travel where it rests upon the outer valve seat 340 to close the outer outlet 40. In addition, at step 0 the toilet tank 24 is filled with flushwater, using any suitable filling means. Once the level of the flushwater rises above the upper end 230 of the outer wall 210 to form the water column A, the flushwater flows into inner cavity/vessel 300 to form water columns B and C, as previously discussed. Specifically, as the flushwater enters the inner cavity/vessel 300, it first fills the lower inner cavity 300A, such that once the flushwater level rises in the lower inner cavity 300A to reach the control ports 400, flushwater enters the outer cavity/vessel 310 to form water column C on top of or above the outer float 460. In addition, flushwater continues to enter the inner cavity/vessel 300 filling the lower and upper inner cavities 300A and 300B, thus completing the formation of the water columns B and C, and forming the normal or resting flushwater level, denoted as "NL" in the toilet tank 24. Thus, at phase 0 water column A in the toilet tank 24 is formed, such that the water column A rises just above the upper end 230 of the outer wall 210 of the flush valve 20 at water level NL, which results in the formation of water column B within the inner cavity/vessel 300; and water column C within the outer cavity/vessel 310. The weight of water columns B and C on respective inner and outer floats 450,460 ensure that the floats 450,460 remain secure on their respective valve seats 330,340, and thereby prevent flushwater from flowing out of the inner and outer outlets 30,40 of the valve 20 at stage 0.

Figure 7:
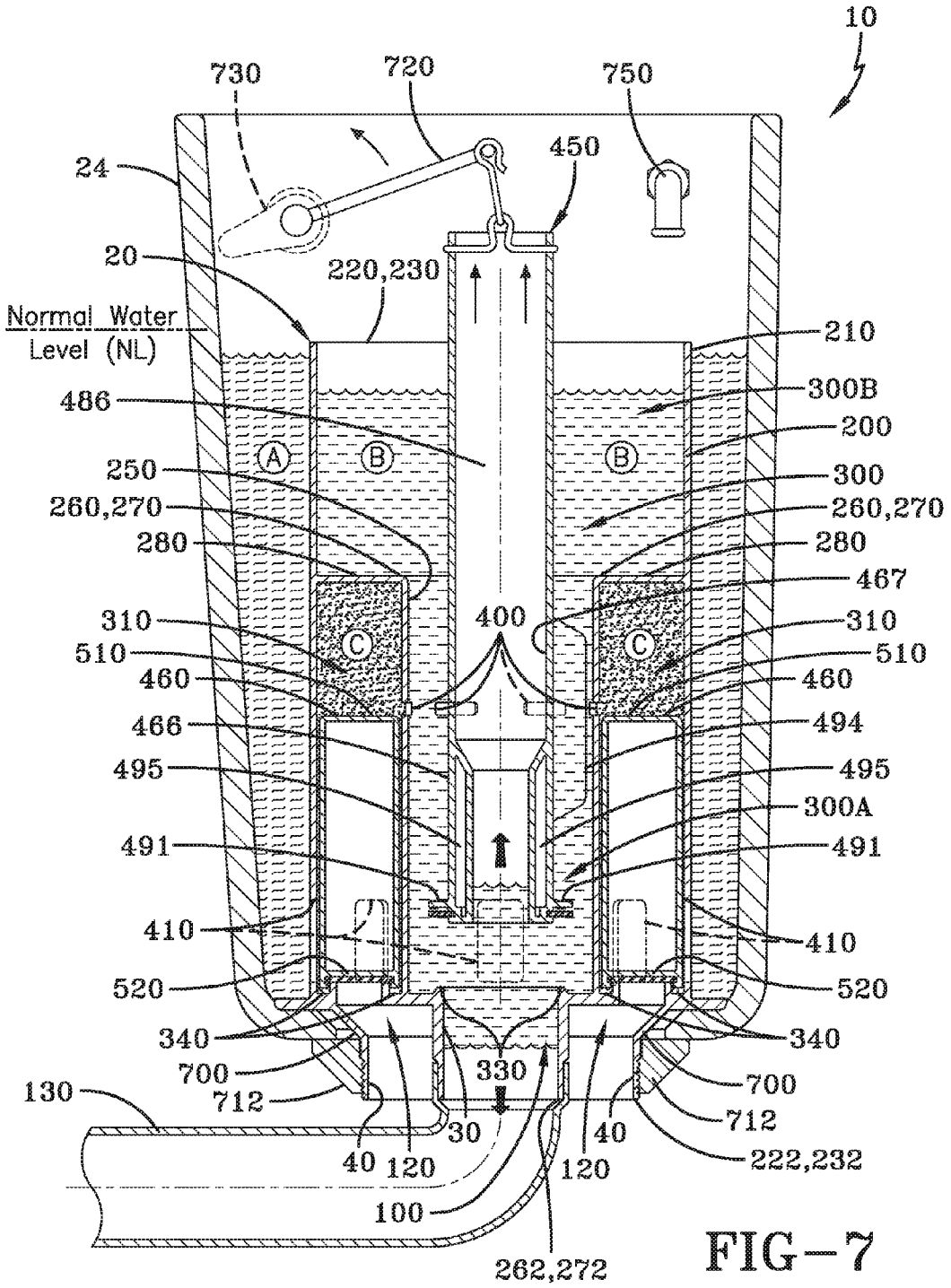
FIG. 7 is a cross-sectional view of the toilet tank and multi-stage flush valve showing the inner valve in an opened state and the outer valve in a closed state in accordance with the concepts of the present invention.
Figure 8:
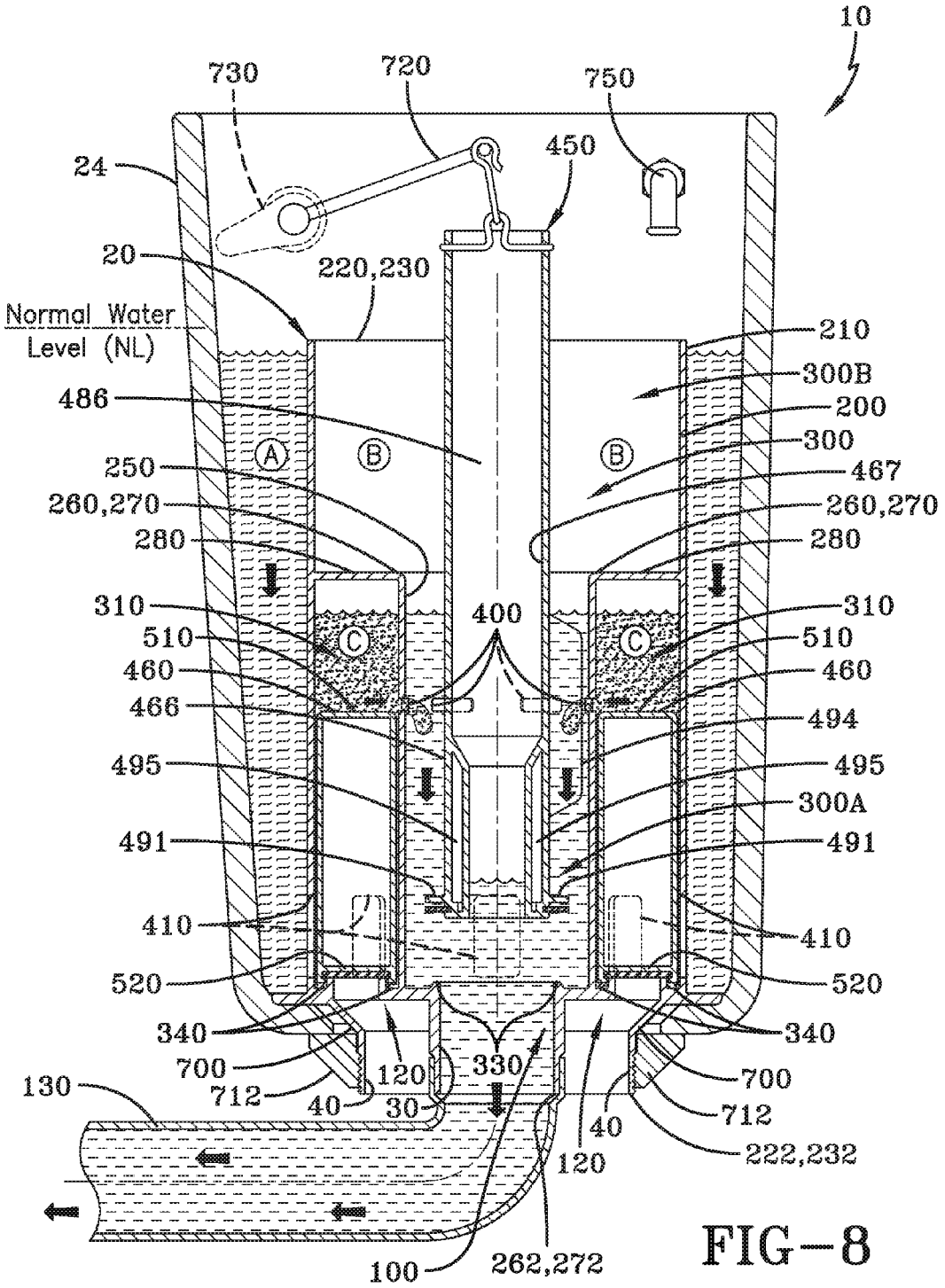
FIG. 8 is a cross-sectional view of the toilet tank and multi-stage flush valve showing the inner valve in an opened state and the and outer valve in a closed state, as flushwater from water column C exits the outer valve in accordance with the concepts of the present invention.

Next, at step or phase 1 of the flush sequence, as shown in FIG. 7, the user actuates the toilet flush lever 730, which results in the upward pulling of lifting of the inner float 450 off of the inner valve seat 330. This opens the inner outlet 30, and allows flushwater of water column B in the inner cavity 300 to begin to flow out of the valve 20 through the inner outlet 30, thereby causing water column B to drop or move downward. Next, as the water column B drops to the approximate height of the dividing section 280, as shown in FIG. 8, phase 2 of the flush valve 20 operation is entered, whereby flushwater forming water column C begins to flow out of the inner control ports 400 from the outer cavity 310 into the inner cavity 300A, where it is combined with the flushwater in water column B before exiting the flush valve 20 through the inner outlet 30. Thus, for a period of time, both water columns B and C continue to be depleted or emptied via inner valve 100, so as to substantially complete stage 1 of the flush sequence, whereby flushwater is delivered to the toilet 10 via the inner outlet 30, as shown in FIG. 8. During this time, the weight of water column C continues to hold the outer float 460 downward, thereby keeping the inner control ports 400 open to allow the flow of flush water forming water column C out of the outer cavity/vessel 330 into the inner cavity/vessel 300.

Figure 9:
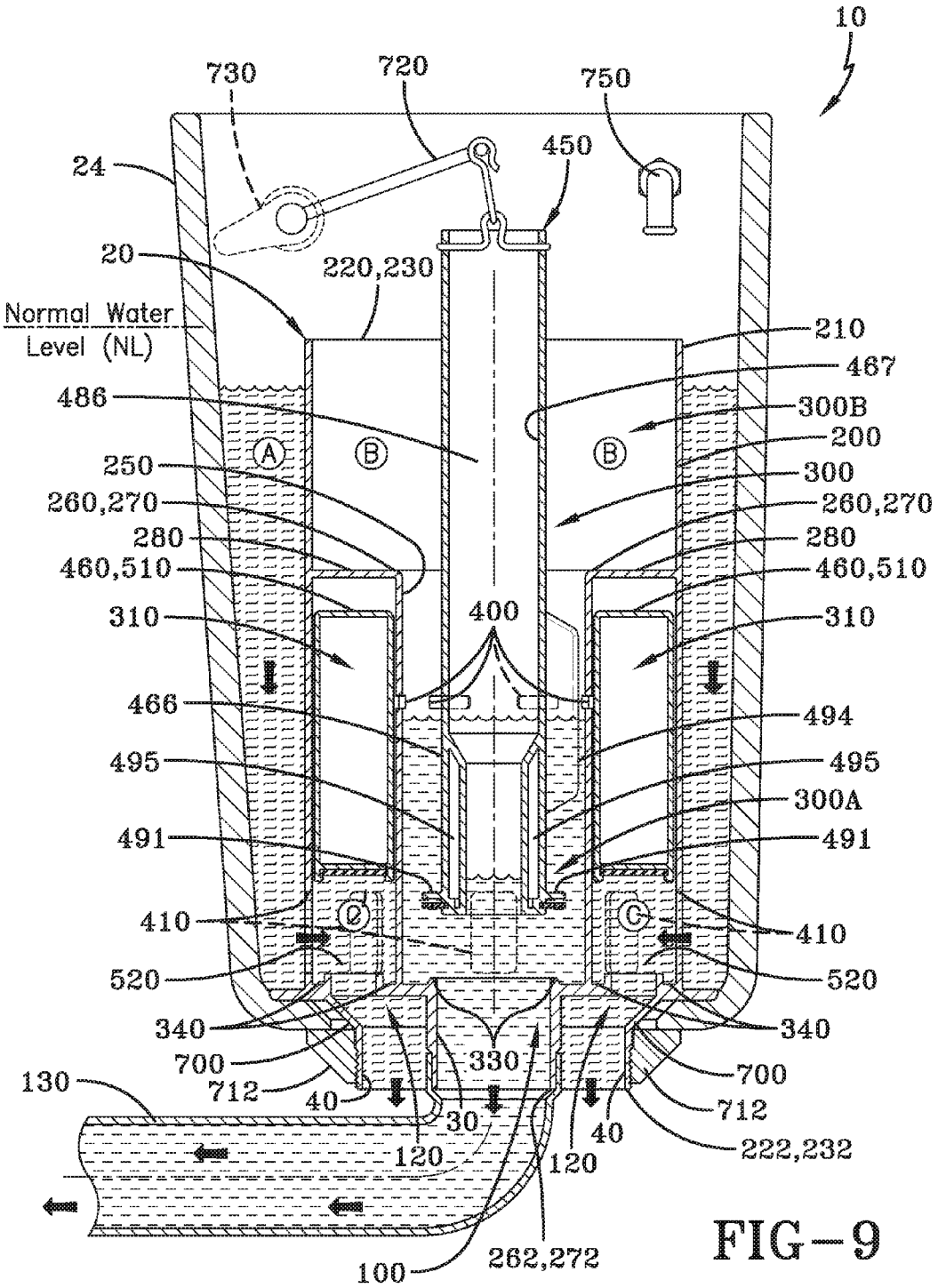
FIG. 9 is a cross-sectional view of the toilet tank and multi-stage flush valve showing the inner and outer valves in an opened state in accordance with the concepts of the present invention.

However, as water column C becomes progressively depleted, and its weight lessened, the buoyancy of the outer float 460 overcomes the weight of the depleted water column C, and begins to float upward away from the outer valve seat 340, whereupon the flush valve 20 enters phase 3, as shown in FIG. 9. Such buoyancy of the outer float 460, and its upward movement is facilitated by the flushwater from water column A that is permitted to enter the outer control ports 410 positioned near the bottom of the outer cavity 310. That is, the outer float 460 rises upward off of the outer valve seat 340, while the outer control ports 410 are opened to allow flush water from water column C to enter the outer cavity/vessel 310. As such, because the outer valve seat 340 is now opened, the flush water from water column A that enters the outer cavity/vessel 310 from the toilet tank 24 is routed through the opened outer valve seat 340 and out of the outer outlet 40, as shown in FIG. 9. As such, phase 3 substantially completes stage 2 of the flush sequence.

Figure 10:
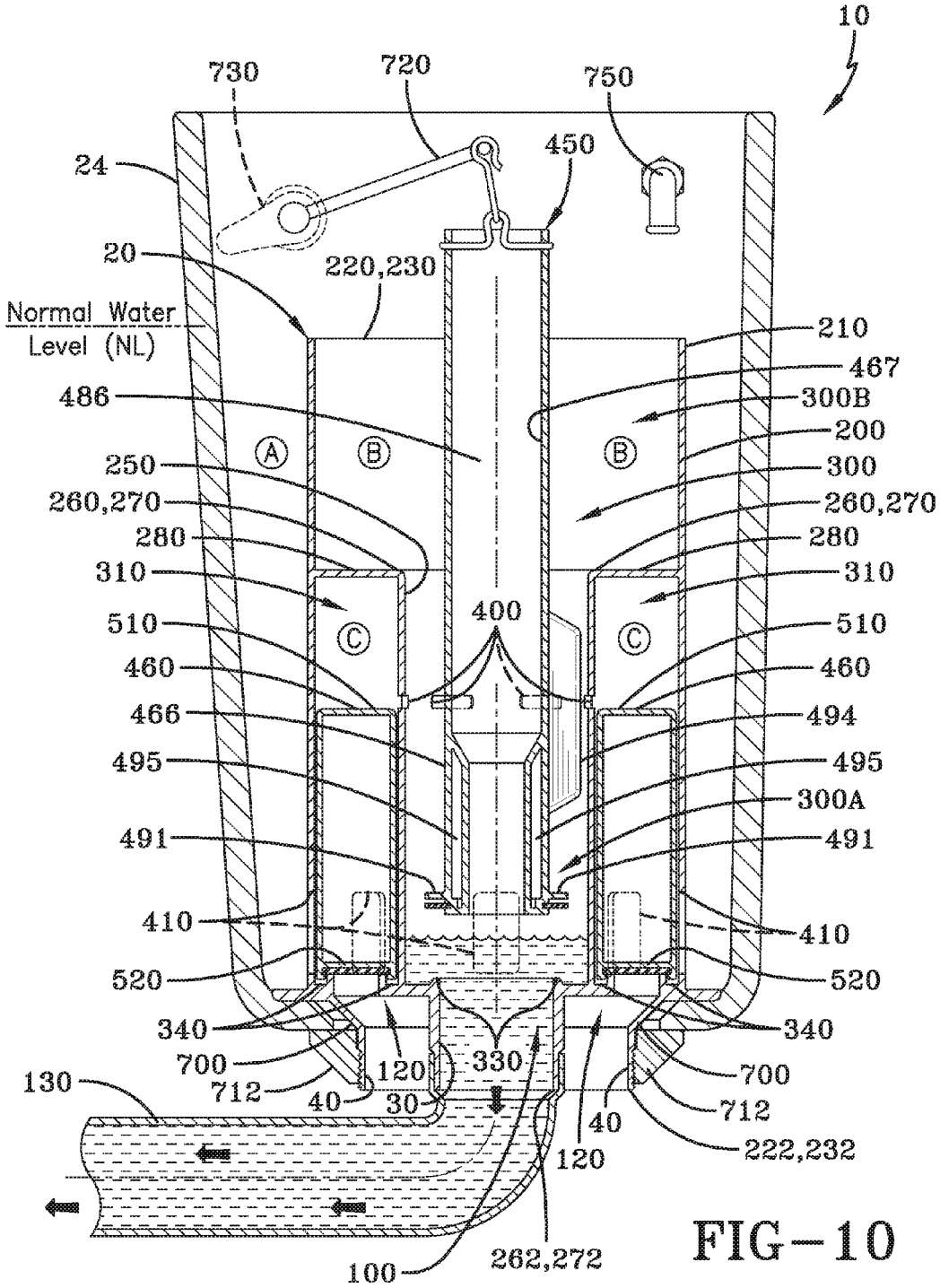
FIG. 10 is a cross-sectional view of the toilet tank and multi-stage flush valve showing the inner float moving to close the inner valve, while the outer valve is in a closed state in accordance with the concepts of the present invention.

After phase 3 has been completed, the flush valve 20 may be configured to carryout phase 4 in various manners. For example, the flush valve 20 may be configured to carry out phase 4 as shown in FIG. 10, whereby the inner and outer outlets 30,40 are dimensioned or configured, such that the inner valve 100 continues to remain open while the outer valve 120 is closed. In other words, the flush valve 20 operates such that the flushwater of water column A that is in the toilet tank 24 is first depleted, so that the outer float 460 moves downward to close the valve seat 340, so as to close the outer outlet 40. At substantially the same time, the flushwater of water column B that is in the inner cavity 300 is permitted to continue flow through the inner outlet 30 via the inner valve 100 is opened.

Figure 11:
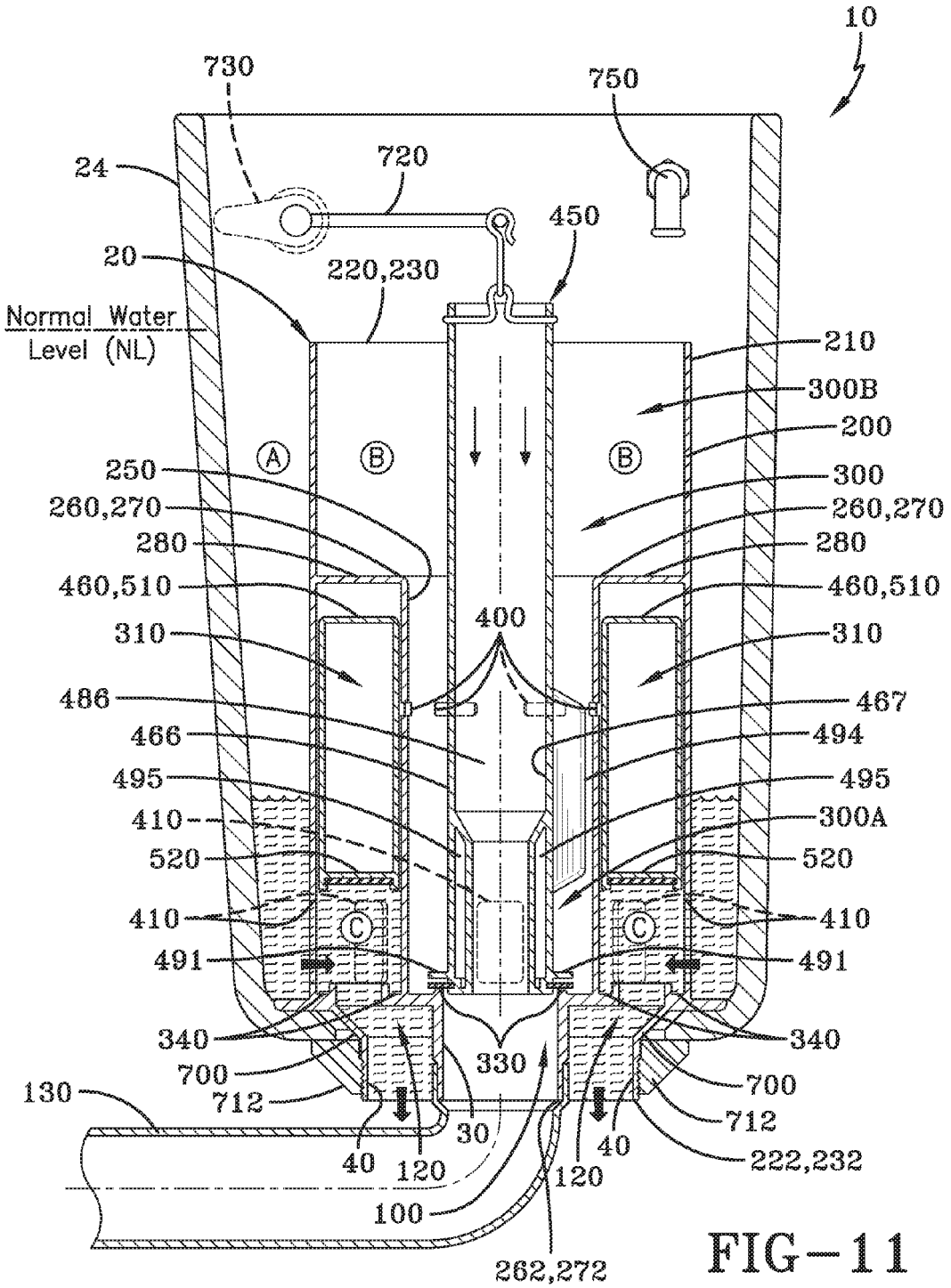
FIG. 11 is a is a cross-sectional view of the toilet tank and multi-stage flush valve showing the inner valve in a closed state and the outer valve in an opened state in accordance with the concepts of the present invention.

However, in other embodiments, the flush valve 20 may be configured to carry out phase 4, as shown in FIG. 11, whereby the inner valve 100 is first shut off, having delivered its intended water capacity, while the outer valve 120 continues delivering water to the outer outlet 30.

Figure 12:
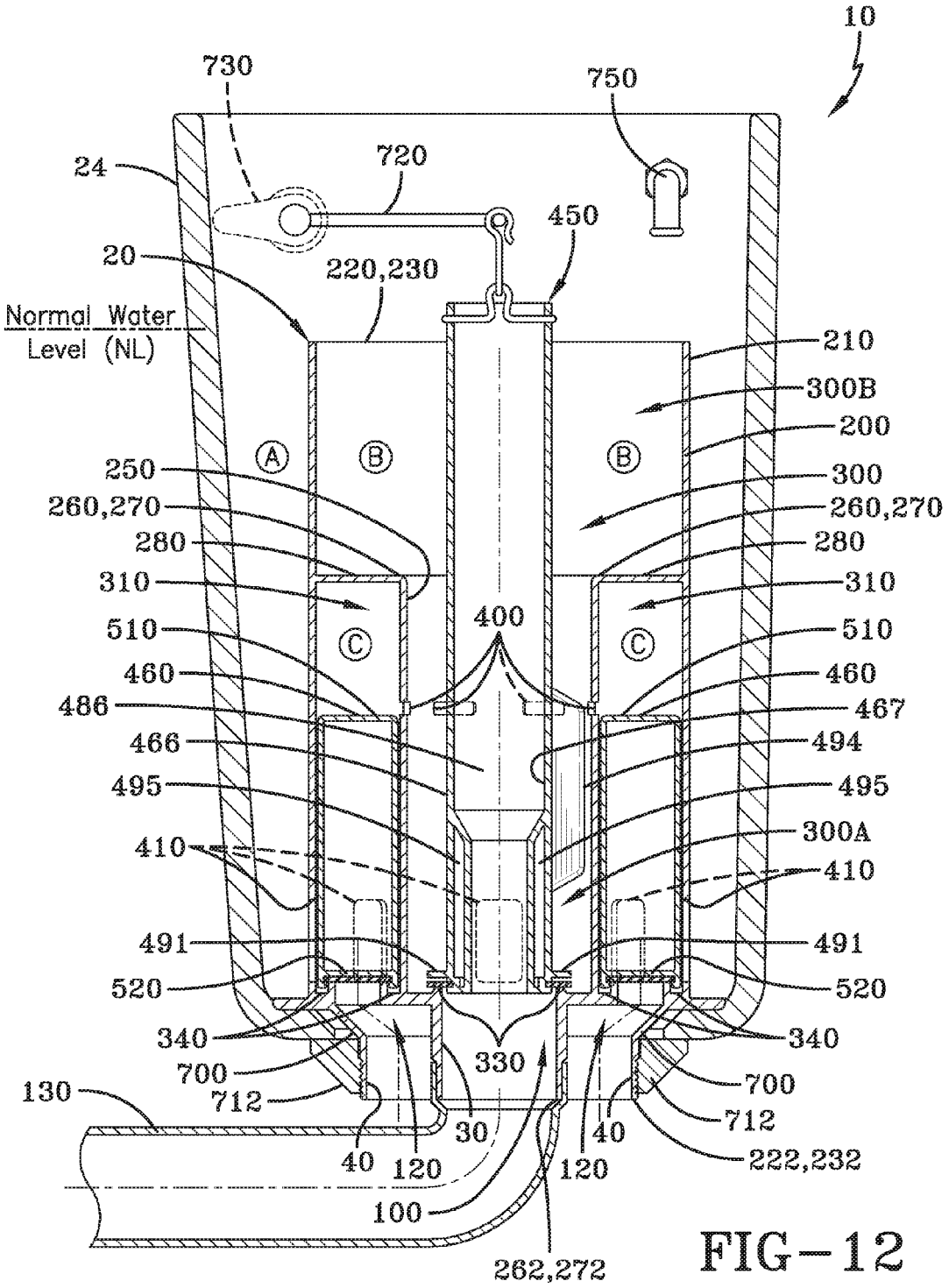
FIG. 12 is a cross-sectional view of the toilet tank and multi-stage flush valve showing the inner and outer valves in a closed state in accordance with the concepts of the present invention.

In other embodiments, phase 4 of the flush valve the inner and outer valves 100,120 are closed at substantially the same time, so as to substantially simultaneously stop the flow of flushwater out of the respective inner and outer outlets 30,40, as shown in FIG. 12.

In any event, after phase 4, is completed, the flush valve enters phase 5, whereby the flow of flushwater out of the inner and outer outlets 30,40 is stopped, as is also shown in FIG. 12. Thus, at phase 5, both the inner and outer valves 100,120 are closed, both having delivered their intended water capacity from their associated water columns. At this stage, the refill valve 750 within the tank 10 operates to refill tank 10, thereby recharging all three water columns A, B and C. Once recharged, the toilet 10 is then ready to be flushed by the user again.

It should be appreciated that the flow rates of the inner and outer valves 100,120 of the multi-stage flush valve 20 may be tuned to any suitable flow rate to set a desired timing sequence with which the valves 100,120 are opened or closed, so as to control the relative time in which stage 1 and stage 2 of the flush sequence are performed.

Therefore, one advantage of the present invention is that a multi-stage toilet flush valve provides two independent flushwater outlets, whereby flushwater is delivered thereto at separate times. Another advantage of the present invention is that the multi-stage toilet flush valve provides increased control over the ratio of flushwater that is delivered to each of the independent flushwater outlets to optimize the cleaning of the toilet bowl.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A flush valve to be mounted in a tank of a toilet, the flush valve comprising:

a body including a first vessel and a second vessel, wherein said first and second vessels are separated by an inner wall having at least one control port disposed therein to allow said first and second vessels to be in fluid communication with each other;

a first valve provided in said first vessel to control the flow of fluid therein through a first valve outlet; and a second valve provided in said second vessel to control the flow of fluid therein through a second valve outlet, wherein said first valve outlet and said second valve outlet are separate;

wherein the release of a predetermined amount of fluid from said first vessel through said first valve outlet upon the activation of said first valve, activates said second valve to release fluid from said second vessel through said second valve outlet.

2. The toilet flush valve of claim 1, wherein said first vessel is disposed within said second vessel.

3. The toilet flush valve of claim 2, wherein said first vessel and said second vessel are concentric with each other.

4. The toilet flush valve of claim 1, wherein said first valve is disposed within said second valve.

5. The toilet flush valve of claim 4, wherein said first valve and said second valve are concentric with each other.

6. The toilet flush valve of claim 1, wherein said body, said first vessel, and said second vessel are cylindrical in shape.

7. The toilet flush valve of claim 1, wherein said second vessel is at least partially defined by an outer wall having at least one control port disposed therein, so as to supply the fluid in the second vessel from the tank of the toilet.

8. A method of operating a toilet flush valve in a tank of a toilet, the method comprising:

providing a first flush valve to control the flow of fluid out of a first outlet, said first outlet in fluid communication with a first vessel, a second vessel in operative communication with said first vessel, said second valve configured to control the flow of fluid out of a second outlet, said second outlet in fluid communication with a second vessel, wherein said first outlet and said second outlet are separate;

actuating said first valve;

releasing water out of said first vessel;

actuating said second valve after a predetermined amount of water is released from said first vessel; and releasing water out of said second vessel.

9. The method of claim 8, wherein said first vessel is disposed within said second vessel.

10. The method of claim 9, wherein said first vessel and said second vessel are concentric with each other.

11. The method of claim 8, wherein said first valve is disposed within said second valve.

12. The method of claim 11, wherein said first valve and said second valve are concentric with each other.

13. The method of claim 8, wherein said first vessel and said second vessel are cylindrical in shape.

14. The method of claim 8, wherein said second vessel is at least partially defined by an outer wall having at least one control port disposed therein, so as to supply the fluid in the second vessel from the tank of the toilet.

15. The toilet flush valve of claim 1, wherein said second valve outlet is positioned at least partially around said first valve outlet.

16. The toilet flush valve of claim 15, wherein said first valve outlet is concentric with said second valve outlet.

17. The method of claim 8, wherein said second outlet is positioned at least partially around said first outlet.

18. The method of claim 17, wherein said first outlet is concentric with said second outlet.

* * * * *